United States Patent [19]

Berg

[11] 4,033,235

[45] July 5, 1977

[54] FLUID OPERATED RAM

[75] Inventor: Lawrance F. Berg, Lockport, Ill.

[73] Assignee: Caterpillar Tractor Co., Peoria, Ill.

[22] Filed: Jan. 26, 1976

[21] Appl. No.: 652,357

[52] U.S. Cl. ..... 91/396; 91/405

[51] Int. Cl.[2] ..... F15B 15/22

[58] Field of Search ..... 91/396, 395, 405, 394

[56] References Cited

UNITED STATES PATENTS

| | | | |
|---|---|---|---|
| 2,605,612 | 8/1952 | Mason | 91/396 |
| 3,054,384 | 9/1962 | Darling | 91/396 |
| 3,470,792 | 10/1969 | Darling | 91/396 |
| 3,704,650 | 12/1972 | Berg | 91/396 |

FOREIGN PATENTS OR APPLICATIONS

| | | | |
|---|---|---|---|
| 188,225 | 10/1966 | U.S.S.R. | 91/394 |

*Primary Examiner*—Paul E. Maslousky
*Attorney, Agent, or Firm*—Phillips, Moore, Weissenberger, Lempio & Majestic

[57] ABSTRACT

The invention is concerned with an improved fluid operated hydraulic ram wherein the travel of the piston thereof is cushioned to reduce impact by progressively restricting fluid flow. The ram of the invention comprises a housing defining a generally cylindrical ram bore having a first wall at a first end thereof with a first hole generally centrally therethrough and a second wall at a second end thereof with a second hole generally centrally therethrough leading to a chamber. A piston fits reciprocally within the ram bore and includes a piston rod extending therefrom through the first hole and a snubber extending from the opposite side thereof towards the second hole. The snubber is sized to pass into the second hole in spaced flow restrictive relation thereto towards the chamber to create a relatively higher pressure in the ram bore adjacent the second end thereof than in the chamber. A valve forms a part of the ram, the valve being adapted to pass a first fluid flow from a first conduit which communicates with the chamber to a sump. A second conduit communicates a second fluid flow from the second end of the ram bore with the valve to adjust the valve to meter the amount of the first fluid flow. A third conduit communicates with the ram bore adjacent the first wall and a pump is provided which causes a third fluid flow from the sump selectively to either the first or third conduit.

7 Claims, 2 Drawing Figures

60
10
90
86
58
88
80
56
92
82
50
48
62
84
26
44
28
34
38
20
52
22
30
24
46
40
12
42
36
14
18
16

Z
50
124
54
74
118
120
108
78
76
94
98
100
112
64
72
68
66
128
102
116
106
110
104
96
70
126
48
62
122
114
X
Y

FLUID OPERATED RAM

BACKGROUND OF THE INVENTION

Field of the Invention

The invention is concerned with fluid operated hydraulic rams and more particularly with valve means for progressively restricting the flow of fluid from a hydraulic ram as the piston thereof reaches the end of a stroke. In this manner the piston is de-accelerated to a lower velocity to reduce the impact as the piston reaches the end of a stroke. This is important since extensive damage can be done when the cylinder and piston of the ram unrestrictedly reach the end of the piston stroke. In certain particular applications such as, for example, on earth moving excavators, hydraulic ram circuits operate at relatively high speeds and thus the damage that might be done to the cylinder and piston of the ram in the absence of some type of cushioning may be quite extensive.

Prior Art

The basic idea of cushioning hydraulic rams or cylinders as the cylinder approaches an end of a stroke is, of course, well known. Representative of prior art cushioning means are those taught, for example, in U.S. Pat. Nos. 3,845,694; 3,802,319; 3,704,650; and 3,691,902 and in British Patent specification 1,372,809. The abovementioned British Patent specification in particular provides a pair of ports adjacent one end of a hydraulic ram cylinder or bore and means for producing a pressure differential between the two ports whereby a two position spool valve is shifted from an unrestricted flow position to a restricted flow position as the piston approaches the end of the cylinder which includes the two ports.

While the prior art cushioning means each have significant advantages, none of them provide a progressive adjustment of the cushioning with the amount of cushioning increasing markedly and smoothly as the piston approaches the cushioned end of the ram cylinder. Further, the prior art devices do not provide for selective adjustment of the amount of cushioning whereby the amount of cushioning of a particular ram can be operator adjusted for different use conditions. Still further, the use of a snubber sized to be significantly smaller in diameter than a hole through which it passes whereby galling is prevented when the piston retracts is not a part of the prior art cushioning means.

The present invention provides a fluid operated hydraulic ram having cushioning means which provide the aforementioned advantages.

SUMMARY OF THE INVENTION

The invention is concerned with a fluid operated hydraulic ram. The ram comprises a housing defining a generally cylindrical ram bore having a first wall at a first end thereof with a first hole generally centrally therethrough and a second wall at a second end thereof with a second hole generally centrally therethrough leading to a chamber. A piston is within the ram bore and has a piston rod extending therefrom through the first hole and a snubber extending from an opposite side thereof towards the second hole, the snubber being sized to pass into the second hole in spaced flow restrictive relation thereto towards the chamber to create a relatively higher pressure in the ram bore adjacent the second end thereof then in the chamber. First conduit means are provided communicating with the chamber. Valve means are arranged to communicate between the first conduit means and the sump, said valve means being adapted to pass a first fluid flow from the first conduit means to the sump. Second conduit means are provided adjacent the second end of the ram bore and communicating a second fluid flow therefrom with the valve means to progressively adjust the valve means to meter the amount of the first fluid flow. Third conduit means are provided communicating with the ram bore adjacent the first wall and pump means are included for providing a third fluid flow from the sump selectively to a respective one of the first conduit means and the third conduit means.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENT

Figure 1:
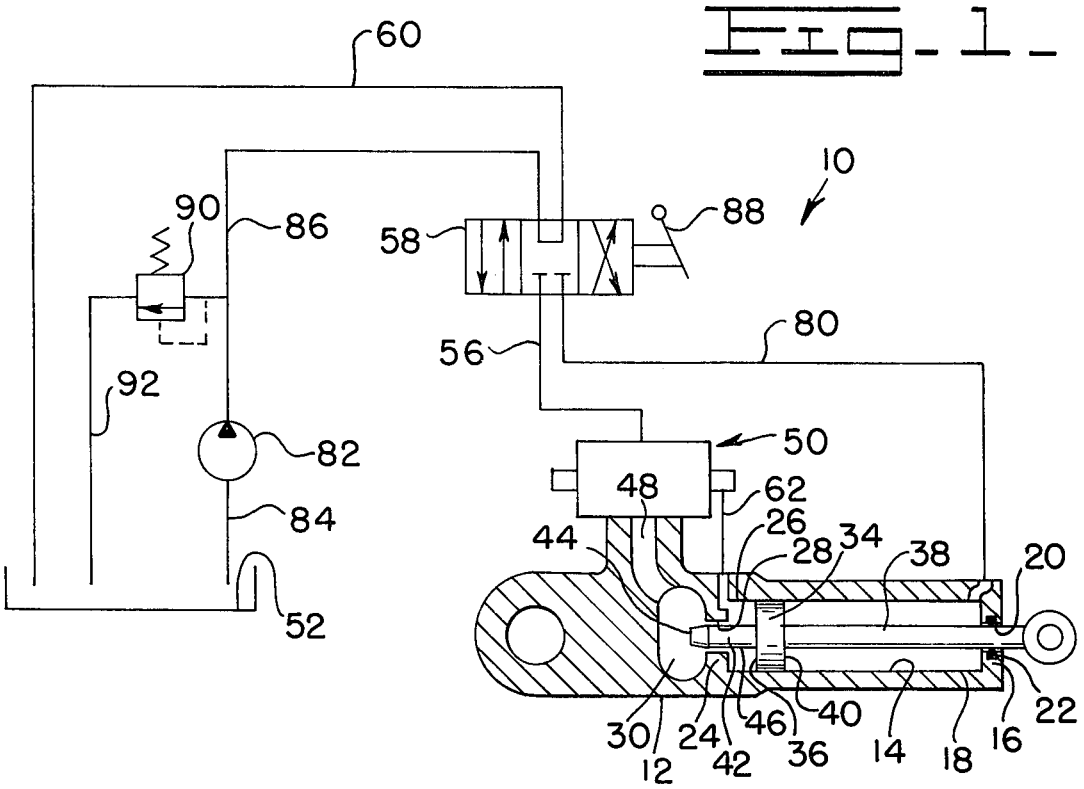
FIG. 1 illustrates schematically, partially in section, a fluid operated hydraulic ram in accordance with the present invention.

Referring first to FIG. 1 there is illustrated therein a fluid operated hydraulic ram 10 of the present invention which includes a housing 12 defining a generally cylindrical ram bore 14 having a first wall 16 at a first end 18 thereof with a first hole 20 generally centrally through said first wall 16 and generally having a seal means 22 therein. The ram bore 14 also has a second wall 24 at a second end 26 thereof with a second hole 28 generally centrally through the second wall 24 leading to a chamber 30.

A piston 34 moves reciprocally within the ram bore 14. The piston 34 has a first face 36 facing the second wall 24. A piston rod 38 extends from a second side 40 of the piston 34 and through the first hole 20 in contact with the sealing means 22. A snubber 42 extends from the first side 36 of the piston 34 towards the second hole 28. The snubber 42 is sized to pass into the second hole 28 in spaced apart flow restrictive relation thereto towards and generally into the chamber 30 to create a relatively higher pressure in the ram bore 14 adjacent the second end 26 thereof then in the chamber 30. As is illustrated in FIG. 1, the snubber 42 can be tapered so that a forward end 44 thereof is smaller than rearward end 46 thereof. It will be noted that the second wall 24 will abut the piston 34 before the snubber 42 can contact the walls defining the chamber 30. In this manner, as the forward end 44 of the snubber 42 first enters the second hole 28 the flow from the second end 26 of the ram bore 14 to the chamber 30 via the second hole 28 is reduced to a first value. Then, as the forward end 44 of the snubber 42 proceeds further into the second hole 28 and generally into the chamber 30 this flow is reduced in value as the larger rearward end 46 of the snubber 42 approaches the second hole 28 and as the forward end 44 enters the chamber 30 thus reducing the effective area of the opening between the chamber 30 and the second end 26 of the bore 14. Thus, the pressure differential between the second end 26 of the ram bore 14 and the chamber 30 increases as the piston 36 more closely approaches the second wall 24.

Figure 2:
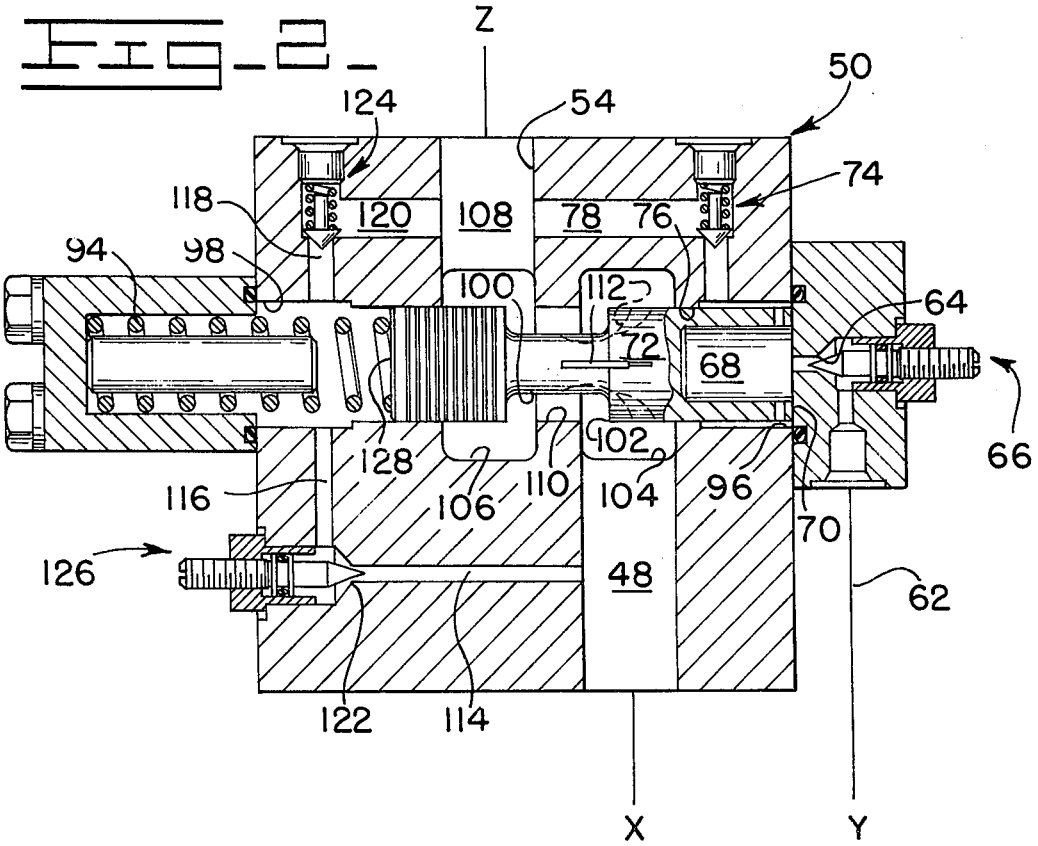
FIG. 2 illustrates in a blown up view in section the preferred valve means of the fluid operated hydraulic ram of the present invention.

First conduit means, in the embodiment illustrated in FIGS. 1 and 2 a first conduit 48 communicates at one end thereof with the chamber 30. Valve means, in the embodiment illustrated a valve 50 whown in detail in FIG. 2 is arranged to communicate between the first conduit 48 and a sump 52. The valve 50 is thus adapted to pass a first fluid flow from the first conduit 48 to the sump 52. The first fluid from the first conduit 48 to the sump 52 proceeds via the valve 50, a port 54 thereof, a line 56, a flow control selector 58, and a drain line 60.

Second conduit means, in particular a second conduit 62 adjacent the second end 26 of the ram bore 14 communicates a second fluid flow from said second end 26 of the ram bore 14 with the valve 50 to progressively adjust the valve 50 to meter the amount of the first fluid flow. The second conduit 62 preferably extends to the bore 14 through the second wall 24 so as to allow flow therethrough at all locations of the piston 34. In the preferred embodiment as illustrated, the second conduit 62 includes a first adjustable orifice 64 in the form of a screw thread adjustable first needle valve 66. The first adjustable orifice 64 allows modification of the pressure of the second fluid flow to a cavity 68 adjacent a first end 70 of a spool 72. A first relief valve means, in the embodiment illustrated a first spring loaded relief valve 74 is provided in flow communication with the first orifice 64 and with a valve bore 76 for the spool 72. The first relief valve 74 serves to limit the pressure of the second fluid flow in that if this pressure gets large enough to open the first relief valve 74 the fluid contributing to said pressure is leaked via a passage 78 which leads to the port 54.

The fluid operated hydraulic ram 10 of the present invention further includes third conduit means, in the embodiment illustrated a third conduit 80 communicating with the ram bore 14 adjacent the first end 18 thereof. Pump means, in the embodiment illustrated a pump 82 provides a third fluid flow via a line 84 and a line 86 from the sump 52 selectively to a respective one of the first conduit 48 and the third conduit 80. The particular setting for the flow control selector 58, as by moving a control lever 88 thereof, determines whether the third fluid flow proceeds to the first end 18 of the bore 14 or to the second end 26 thereof. The setting of the control lever 88 of the flow control selector 58 also determines whether the third conduit 80 is connected to sump via the drain line 60. It is clear that whenever the third conduit 80 is connected to the sump 52 via the flow control selector 58 and the drain line 60 then the first conduit 48 is connected for filling from the pump 82, the line 86, the flow control selector 58, the line 56 and the valve 50. A spring loaded one-way pressure relief valve 90 is provided between the line 86 and the sump 52 with which it communicates as via a line 92.

Turning now most specifically to the structure of the valve 50 as illustrated in FIG. 2 it is clear that the valve in the preferred embodiment of the invention comprises the spool 72 slidably mounted within the valve bore 76 and spring biased as by a spring 94 towards a first end 96 of the valve bore 76. The first conduit 48, as illustrated, communicates with the valve bore 76 intermediate its first end 96 and a second end 98 thereof. The spool 72 and the valve bore 76 provide a substantially unrestricted flow path to the flow control selector 58 when the spool 72 is positioned by the spring 94 to be adjacent the first end 96 of the valve bore 76. Further, the spool 72 and the valve bore 76 provide a progressively restrictive flow path to the flow control selector 58 as the spool 72 shifts away from the first end 96 of the valve bore 76. This occurs since an undercut 100 in the spool 72 is moved sufficiently so that a shoulder 102 formed at one end thereof begins to close off the bore 76 to prevent unrestricted flow from a first annulus 104 in the bore 76 to a second annulus 106, likewise in the bore 76 and communicating with the port 54 via a passage 108 in the body of the valve 50. It will be clear from careful examination of FIG. 2 that as the shoulder 102 approaches an intermediate portion 110 of the bore 76, flow from the first annulus 104 to the second annulus 106 must proceed via a plurality of arcuate slots 112 in the spool 72. Thus, flow is restricted fairly smoothly when the shoulder 102 of the spool 72 approaches the intermediate portion 110 of the bore 76 and then is more slowly cut off as the arcuate slots 112 are blocked off while the spool 72 travels further away from the first end 96 of the bore 76 and closer to the second end 98 thereof. It is clear that the second conduit 62 communicates with the cavity 68 and, of course, with the first end 96 of the valve bore 76 and that pressure therein causes movement of the spool 72 against the biasing of the spring 94 and against any fluid pressure which may be present in the bore 76 adjacent the second end 98 thereof. Since as previously explained, the pressure differential between the pressure in the second conduit 62 and the pressure in the first conduit 48 increases markedly as the snubber 42 proceeds into the second hole 28, it is clear that the spool 72 will be shifted against the force of the spring 94 as the piston 34 approaches the second end 26 of the ram bore 14. Thus, movement of the spool 72 against the spring 94 is responsive to pressure in the second conduit 62 exceeding pressure in the first conduit 48 as the snubber 42 restricts fluid flow from the ram bore 14, and more particularly from adjacent the second end 26 thereof, to the chamber 30.

The valve 50 generally includes fourth conduit means, in particular a plurality of passages 114, 116, 118 and 120 in series with one another which serve to communicate the first conduit 48 with the sump 52 via the flow control selector 58. The fourth conduit means includes a second adjustable orifice 122 to modify the pressure of the first fluid flow therethrough and second relief valve means, in the embodiment illustrated a second relief valve 124 generally of the spring loaded variety intermediate the second orifice 122 and the flow control selector 58. The second adjustable orifice 122 generally comprises a second needle valve 126 which may be generally screw adjusted to adjust the size of the second adjustable orifice 122. Fluid flow which passes through the passage 116 is applied to a second end 128 of the spool 72 and serves to act along with the force of the spring 94 against the force of fluid within the cavity 68. It is clear that the second relief valve 124 opens when the first fluid pressure, as modified by the second needle valve 126, reaches a predetermined value.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A fluid operated ram with means for reducing impact as the ram closes, comprising:

1. a housing defining a generally cylindrical ram bore having a first wall at a first end thereof with a first hole generally centrally therethrough and a second wall at a second end thereof with a second hole generally centrally therethrough leading to a chamber;
2. a piston within said ram bore having a piston rod extending therefrom through said first hole and a snubber extending from an opposite side thereof towards said second hole, said snubber being sized to pass into said second hole in spaced flow restrictive relation thereto towards said chamber to create a relatively higher pressure in said ram bore adjacent said second end thereof than in said chamber;
3. first conduit means communicating with said chamber;
4. valve means arranged to communicate between said first conduit means and a sump, said valve means including means biasing said valve means to provide a substantially unrestricted flow path from said first conduit means to said sump to pass a first fluid flow, said flow path being progressively restricted responsive to shifting of said valve means against said biasing means;
5. second conduit means adjacent said second end of said ram bore and communicating a second fluid flow therefrom with said valve means to shift said valve means in opposition to said biasing means responsive to pressure in said second conduit means exceeding pressure in said first conduit means as said snubber restricts fluid flow from said ram bore to said chamber as said snubber moves towards said chamber, said second conduit means including a first adjustable orifice therein to modify the pressure of said second fluid flow to said valve means and first relief valve means communicating said first orifice and said valve means with said sump to limit the pressure of said second fluid flow;
6. third conduit means communicating with said ram bore adjacent said first wall; and
7. pump means for providing a third fluid flow from said sump selectively to a respective one of said first conduit means and said third conduit means.

2. A ram as in claim 1, including:

flow control means for coordinatedly selecting which respective one of said first and third conduit means receives said third fluid flow and which respective other of said first and third conduit means connects to said sump.

3. A ram as in claim 1, wherein said snubber is restricted in length so as to enter but not physically contact the walls of said chamber.

4. A ram as in claim 3, wherein a respective one of said second hole and said snubber is tapered to provide progressive closure of said second hole as said snubber approaches and enters it.

5. A ram as in claim 1, wherein said valve means comprises:

a spool slidably mounted within a valve bore, said biasing means comprises a spring biasing said spool towards a first end thereof with said first conduit means communicating with said valve bore, said spool and said valve bore providing a substantially unrestricted flow path to said flow control means when said spool is adjacent said first end of said valve bore and a progressively restricted flow path to said flow control means as said spool shifts away from said first end of said valve bore;

and wherein said second conduit means is in flow communication with said first end of said valve bore to cause movement of said spool against said spring biasing responsive to pressure in said second conduit means exceeding pressure in said first conduit means as said snubber restricts fluid flow from said ram bore to said chamber.

6. A ram as in claim 5, wherein said second conduit means modifies the pressure of said second fluid flow to said first end of said valve bore and said first relief valve means communicates said first orifice and said valve bore with said sump via said flow control means.

7. A ram as in claim 6, including fourth conduit means communicating said first conduit means with said sump via said flow control means, said fourth conduit means including a second adjustable orifice therein to modify the pressure of said first fluid flow therethrough and second relief valve means intermediate said second orifice and said flow control means opening when said modified first fluid flow pressure reaches a predetermined value, said fourth conduit means communicating with a second end of said valve bore to bias said spool towards said first end of said valve bore for retarding sudden pressure changes to said flow control means.

* * * * *